US007779567B2

(12) United States Patent
Saliege

(10) Patent No.: US 7,779,567 B2
(45) Date of Patent: Aug. 24, 2010

(54) SUPPORT FOR COMMUNICATION MEANS WORN BY A PERSON

(76) Inventor: Sylvaine Yvette Jacqueline Saliege, 1 rue Georges Appay, 92150 Suresnes (FR)

( * ) Notice: Subject to any disclaimer, the term of this patent is extended or adjusted under 35 U.S.C. 154(b) by 62 days.

(21) Appl. No.: 11/676,895

(22) Filed: Feb. 20, 2007

(65) Prior Publication Data

US 2007/0199219 A1 Aug. 30, 2007

Related U.S. Application Data

(63) Continuation of application No. PCT/FR2005/001862, filed on Jul. 20, 2005.

(30) Foreign Application Priority Data

Aug. 20, 2004 (FR) ..... 04 09016

(51) Int. Cl.
*G09F 21/02* (2006.01)

(52) U.S. Cl. ..... 40/586; 224/627

(58) Field of Classification Search ..... 40/586; 224/265, 266, 930; 248/444
See application file for complete search history.

(56) References Cited

U.S. PATENT DOCUMENTS 518,780 A * 4/1894 Fogg ..... 40/586
3,030,109 A * 4/1962 Albitz ..... 482/88
3,322,312 A * 5/1967 Mitchell ..... 224/635
4,298,149 A * 11/1981 Gottschalk et al. ..... 224/201
4,439,763 A * 3/1984 Limb ..... 370/403
5,076,131 A * 12/1991 Patterson ..... 84/421
5,829,652 A * 11/1998 Denzer et al. ..... 224/270
5,912,653 A 6/1999 Fitch
6,393,745 B1 5/2002 Miki
6,843,012 B1 * 1/2005 Dodd ..... 40/586

FOREIGN PATENT DOCUMENTS

| | | |
|---|---|---|
| CH | 118860 | 2/1927 |
| FR | 409 645 | 11/1909 |
| FR | 814487 | 6/1937 |
| FR | 2535881 | 5/1984 |
| FR | 2608823 | 6/1988 |
| FR | 2761507 | 10/1998 |
| JP | 2000-298445 | 10/2000 |
| WO | 03079319 | 9/2003 |

* cited by examiner

*Primary Examiner*—Cassandra Davis
(74) *Attorney, Agent, or Firm*—Dickinson Wright PLLC

(57) ABSTRACT

A communication device support intended to be worn by a person includes a bottom portion intended to be connected to the trunk of the person. The bottom portion has members that bear on the shoulders, the back, and the chest of the person, these members being rigidly connected to each other and conformed to ensure that the bottom portion is inherently stable on the trunk. A top portion holds the communication device above the head of the person, this top portion being rigidly connected to the bottom portion and conformed to enable the free movement of the head. The members that bear on the shoulders include two shoulder straps, a dorsal upright connected to the shoulder straps via a dorsal crossmember, and two pectoral uprights connected to the shoulder straps via a pectoral crossmember, all of these members having an ergonomic shape.

15 Claims, 1 Drawing Sheet

SUPPORT FOR COMMUNICATION MEANS WORN BY A PERSON

TECHNICAL FIELD OF THE INVENTION

The present invention relates to a support for communication means intended to be worn by a person.

BACKGROUND OF THE INVENTION

There is known from international application WO 03 079 319 a support for communication means intended to be worn by a person comprising a bottom portion intended to be connected to the trunk of a person and a top portion intended to hold said communication means above the head of said person.

In this prior art device, the bottom portion is in fact in the form of a backpack connected to the trunk of the person by straps and the top portion is in the form of a tube connected to the backpack.

This tube is intended to carry at its upper end a video screen that can display information intended to be read by the public in the vicinity of a person wearing this device.

Although it constitutes an original way of communicating, this prior art support has the drawback of being relatively unstable: the tube at the end of which the screen is located tends to swing when the wearer moves, which is uncomfortable for that person, dangerous for the public nearby an no less hazardous to the safety of the video hardware.

The document FR 814 487 teaches a communication support analogous to that of WO 03 079 319, i.e. resting on the shoulders of the person by means of straps, and having the same drawback of instability as the support from WO 03 079 319.

To solve this problem of instability, the Japanese company Suntory has placed on the market a competing support in which the bottom portion comprises members that bear on the shoulders, back and chest of the person, these members being rigidly connected together and coupled to the backpack, and the top portion comprises a helmet rigidly connected to said bottom portion.

The helmet is intended to be placed on the head of the wearer and to support the communication means.

Because it bears rigidly on the trunk and on the head of the wearer, this prior art support is very stable.

However, this support has the drawback of immobilizing the head of the wearer relative to his trunk, which constitutes a severe physical constraint for that person and is not very esthetic for the target public.

SUMMARY OF THE INVENTION

One particular object of the present invention is to provide a communication support which, at the same time as being highly stable, preserves the freedom of movement of the wearer, and thereby offers the wearer great physical comfort.

This object of the invention is achieved with a support for communication means intended to be worn by a person, comprising:

- a bottom portion intended to be connected to the trunk of said person, comprising members that bear on the shoulders, the back and the chest of said person, these members being rigidly connected to each other and conformed to ensure that said bottom portion is inherently stable on said trunk, and
- a top portion intended to hold said communication means above the head of said person, this top portion being rigidly connected to said bottom portion and conformed to enable the free movement of said head.

Thanks to these features, a communication support is obtained having the required stability and preserving the freedom of movement of the wearer.

Accordingly, in contrast to what the prior art might suggest, a sufficiently stable support can be obtained without it being necessary to have recourse to ancillary bearing means such as a part bearing on the head of the wearer.

According to an optional feature of the support according to the invention, said top portion comprises two branches defining an inverted Y, connected to respective members that bear on the shoulders and merging in a region in which they are adapted to carry said communication means.

This inverted Y-shape of the top portion of the support according to the invention offers a good compromise between the stability of the support and the freedom of movement of the wearer.

According to another optional feature of the support according to the invention, said branches have a C-shaped profile the concave side whereof is oriented toward the front.

This particular configuration of the top portion of the support according to the invention frees up completely the area situated around the head of the wearer and thus increases the freedom of movement of that person, and renders the support according to the invention both ergonomic and comfortable.

According to another optional feature of the support according to the invention, said bearing members comprise two shoulder straps, a dorsal upright connected to said shoulder straps via a dorsal crossmember, and two pectoral uprights connected to said shoulder straps via a pectoral crossmember, all of these members having an ergonomic shape.

This particular configuration of the bearing members makes the bottom portion of the support according to the invention particularly robust and stable.

According to other optional features of the support according to the invention:

- said pectoral uprights form a triangle in conjunction with said pectoral crossmember,
- said bottom portion and said top portion are fabricated as one unit,
- said bottom portion and said top portion form two separate units that are fixed to each other,
- said bottom portion is based on an aluminum structure covered with flexible polyurethane,
- said top portion is based on a composite material such as a mixture of polyester and glass fibers,
- said support comprises reinforcing rods disposed between said bottom portion and said top portion, The present invention also relates to a communication device noteworthy on that it comprises a support of the above kind and information display means fixed to the top portion of said support.

According to other optional features of this device according to the invention:

- said information display means comprise a flat video screen and means for generating images on said flat screen,
- said means for generating images are separate from said flat screen,
- said means for generating images are chosen from the group comprising CD-ROM players, DVD players, MPEG4 players, games consoles and computers,
- said device further comprises means for broadcasting sound accompanying said images, said device comprises means for remotely controlling the operation of said means for generating images.

BRIEF DESCRIPTION OF THE DRAWINGS

Other features and advantages of the present invention will become apparent on reading the following description and examining the appended drawing, in which.

DETAILED DESCRIPTION OF THE INVENTION

The terms front, side, bottom and top are used hereinafter.

These terms must be understood in relation to the position that the support according to the invention is intended to assume when it is worn by a person, as represented in FIGS. 5 to 8.

Figure 1:
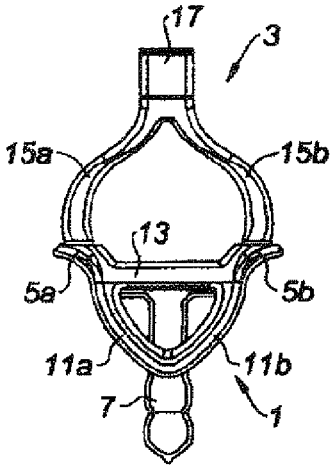
FIGS. 1 to 3 are front, side and perspective views, respectively, one of embodiment of the support according to the invention.
Figure 2:
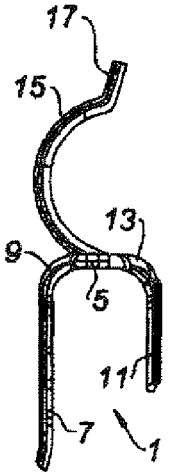
Figure 3:
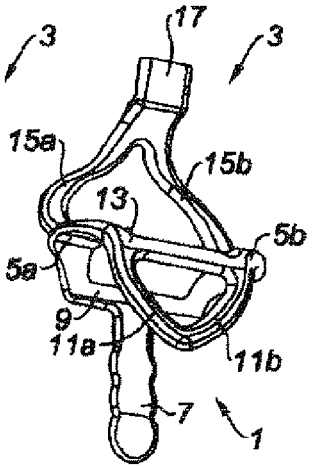

Refer now to FIGS. 1 to 3, in which it is seen that the support of the invention comprises a bottom portion 1 and a top portion 3 that may be fabricated as one unit or as two units that are fixed to each other.

The bottom portion 1 comprises two shoulder straps 5*a* and 5*b*, a dorsal upright 7 connected to the shoulder straps via a dorsal crossmember 9, and two pectoral uprights 11*a*, 11*b* connected to the shoulder straps via a pectoral crossmember 13.

As may be seen in FIGS. 1 and 3 in particular, in conjunction with the pectoral crossmember 13, the two pectoral uprights 11*a* and 11*b* preferably form a triangle.

The top portion of the support according to the invention comprises two branches 15*a*, 15*b* fixed to the shoulder straps 5*a*, 5*b*, respectively, and merging in a region 17 in which they carry fixing means (not shown) for the communication means.

The fixing means may be of any kind and in particular may comprise a system of the mortise and tenon, threaded screw, clipping, etc. type.

Figure 6:
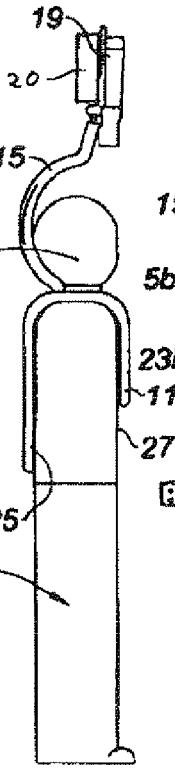
Figure 7:
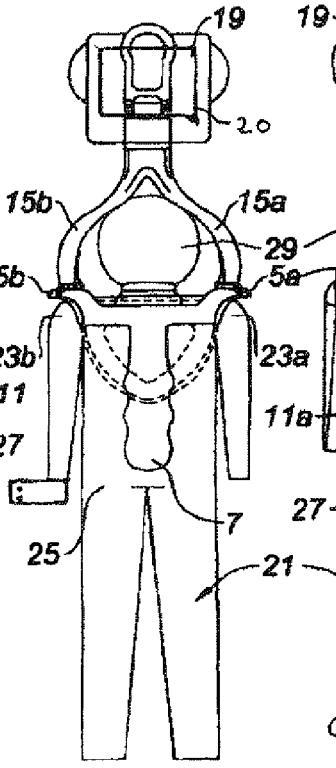
Figure 8:
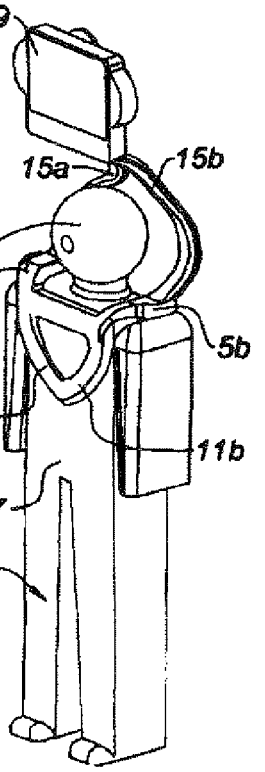

As can be seen in FIGS. 2 and 6 in particular, the part 17 is preferably inclined slightly toward the front, at an angle that may typically be of the order of 15°.

It is therefore clear that, seen from the front, the two branches 15*a* and 15*b* of the upper part 3 form an inverted Y, so to speak.

As can be seen in FIG. 2 in particular, these two branches preferably have a C-shaped profile the concave side whereof is oriented toward the front, i.e. here toward the right-hand side of the appended sheet of drawings.

The bottom portion 1 may be based on an aluminum structure covered with flexible polyurethane and the top portion may be based on a composite material such as a mixture of polyester and glass fibers.

Figure 4:
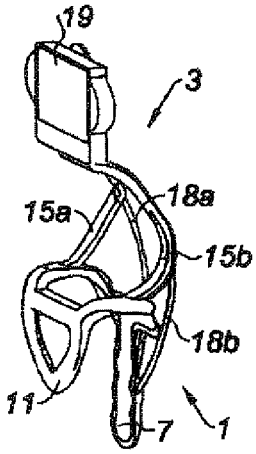
FIG. 4 is a perspective view of a device comprising a variant of the support according to the invention.
Figure 5:
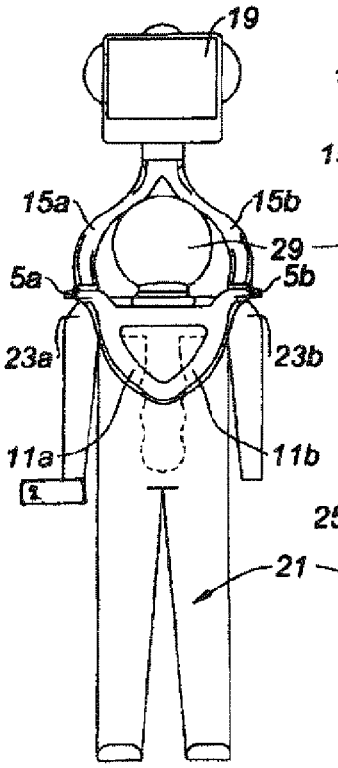
FIGS. 5 to 8 are front, side, rear and perspective views, respectively, of a person wearing a device comprising a support according to the FIGS. 1 to 3.

The FIG. 4 variant differs from the embodiment of FIGS. 1 to 3 in that it comprises reinforcing rods 18*a*, 18*b* disposed between the bottom portion 1 and the top portion 3.

These reinforcing rods may be made from a light metal alloy, for example one based on aluminum.

It will further be noted that in this FIG. 4 the support according to the invention is represented in an operational situation, i.e. in a situation in which it is supporting in the region 17 communication means such as a flat video screen 19.

This flat screen may be an LCD screen such as the SHARP LC-15L1E screen, for example, completely self-contained, operating wirelessly and supplied with power by batteries integrated into the screen.

The use and advantages of the support according to the invention follow directly from the foregoing description.

When it is wished to broadcast a message to a particular public, the communication means 19 (LCD screens or other display panels) are prepared so that they display the message concerned.

When the communication means 19 consist of a video screen, the message may be displayed by means of a digital medium player such as CD-ROM player, a DVD player 20, an MPEG4 player, a games console or a computer, which may be either integrated into the screen 19 or separate from the screen and connected to it by appropriate connecting means.

It may be of course envisaged that the message to be broadcast is an audiovisual message, in which case communication means 19 are chosen that include audio means.

Fixing either directly to the means 19 or to the part 17, means for diffusing fragrances (of the "olfactorymodule" type) may further be envisaged.

Once the communication means 19 have been prepared, the device comprising these communication means and the support according to the invention are placed on a wearer 21.

Thus the shoulder straps 5*a*, 5*b* come to rest on the shoulders 23*a*, 23*b* of the person 21, the dorsal upright 7 is pressed against the back 25 of this person, substantially as far as his pelvis, and the pectoral uprights 11*a*, 11*b* are pressed against the chest 27 of the person.

The pressing of the dorsal upright 7 and of the pectoral uprights 11*a*, 11*b* against the trunk of the person ensure that the support according to the invention is inherently stable: no ancillary means such as a part bearing on the head or a ventral straps are necessary to achieve the required stability. Preferably, the dorsal upright and the pectoral uprights 11*a*, 11*b* provide some elasticity and their spacing is so designed as to ensure a limited clamping against at least one portion of the back and the trunk respectively of the person, which contributes to the fact that the support is inherently stable.

This therefore produces a structure that is light in weight, compact (in particular for moving in a crowd) and highly esthetic and that preserves the freedom of movement of the wearer.

The communication means 19 are placed above the head 29 of this person.

The communication means 19 can therefore be very clearly seen and where applicable heard by a target public within which the person 21 moves around.

It will be noted that the C-shaped profile of the branches 15*a*, 15*b* of the top portion 3 completely frees up the area situated around the head 29 of the person 21 and thereby increases the freedom of movement of that person and renders the support according to the invention both ergonomic and comfortable.

It will also be noted that the inclination of the part 17 means that the communication means 19 can be conveniently oriented toward the target public.

Of course, the present invention is not limited to the illustrative and nonlimiting examples described hereinabove.

The invention claimed is:

1. Support for communication means intended to be worn by a person, comprising:

a bottom portion intended to be connected to the trunk of said person, comprising members that bear on the shoulders, members that bear on the back and members that bear on the chest of said person, these members being rigidly connected to each other and conformed to ensure that said bottom portion is inherently stable on said trunk, and a top portion intended to hold said communication means above the head of said person, this top portion being rigidly connected to said bottom portion and conformed to enable the free movement of said head, wherein said members that bear on the shoulders comprise two shoulder straps, a dorsal upright connected to said shoulder straps via a dorsal crossmember, and two pectoral uprights connected to said shoulder straps via a pectoral crossmember, all of these members having an ergonomic shape, and said top portion comprises two branches defining an inverted Y, connected to respective ones of the members that bear on the shoulders and merging in a region in which they are adapted to carry said communication means.

2. Support according to claim 1, wherein said branches have a C-shaped profile, a concave side whereof is oriented toward the front.

3. Support according to claim 1, wherein said pectoral uprights form a triangle in conjunction with said pectoral crossmember.

4. Support according to claim 1, wherein said bottom portion and said top portion are fabricated as one unit.

5. Support according to claim 1, wherein said bottom portion and said top portion form two separate units that are fixed to each other.

6. Support according to claim 1, wherein said bottom portion is based on an aluminum structure covered with flexible polyurethane.

7. Support according to claim 1, wherein said top portion is based on a composite material.

8. Support according to claim 7, wherein said composite material is a mixture of polyester and glass fibers.

9. Support according to claim 1, comprising reinforcing rods disposed between said bottom portion and said top portion.

10. Communication device, comprising:

a support for communication means intended to be worn by a person, comprising:

a bottom portion intended to be connected to the trunk of said person, comprising members that bear on the shoulders, members that bear on the back and members that bear on the chest of said person, these members being rigidly connected to each other and conformed to ensure that said bottom portion is inherently stable on said trunk, and a top portion intended to hold said communication means above the head of said person, this top portion being rigidly connected to said bottom portion and conformed to enable the free movement of said head and information display means fixed to the top portion of said support, wherein said members that bear on the shoulders comprise two shoulder straps, a dorsal upright connected to said shoulder straps via a dorsal crossmember, and two pectoral uprights connected to said shoulder straps via a pectoral crossmember, all of these members having an ergonomic shape, and said information display means comprise a flat video screen and means for generating images on said flat screen.

11. Device according to claim 10, wherein said means for generating images are integrated into said flat screen.

12. Device according to claim 10, wherein said means for generating images are separate from said flat screen.

13. Device according to claim 10, wherein said means for generating images are chosen from the group comprising CD-ROM players, DVD players, MPEG4 players, games consoles and computers.

14. Device according to claim 10, further comprising means for broadcasting sound accompanying said images.

15. Device according to claim 10, comprising means for remotely controlling the operation of said means for generating images.

* * * * *